US005559706A

United States Patent [19]

Fujita

[11] Patent Number: 5,559,706

[45] Date of Patent: Sep. 24, 1996

[54] APPARATUS FOR DETERMINING ENGINE ABNORMALITY

[75] Inventor: Tomohiro Fujita, Toyota, Japan

[73] Assignee: Toyota Jidosha Kabushiki Kaisha, Aichi-ken, Japan

[21] Appl. No.: 276,397

[22] Filed: Jul. 18, 1994

[30] Foreign Application Priority Data

Jul. 29, 1993 [JP] Japan ..... 5-188496

[51] Int. Cl.[6] ..... F02D 41/22

[52] U.S. Cl. ..... 364/431.11; 364/431.05; 123/520; 123/690

[58] Field of Search ..... 364/431.05, 431.06, 364/431.11; 123/489, 690, 520

[56] References Cited

U.S. PATENT DOCUMENTS

| | | | |
|---|---|---|---|
| 4,926,825 | 5/1990 | Ohtaka et al. | 123/489 |
| 4,961,412 | 10/1990 | Furuyama | 123/520 |
| 5,158,059 | 10/1992 | Kuroda | 123/690 |
| 5,213,088 | 5/1993 | Harada | 123/674 |
| 5,251,592 | 10/1993 | Seki et al. | 123/198 D |
| 5,287,283 | 2/1994 | Musa | 364/431.11 |
| 5,443,051 | 8/1995 | Otsuka | 123/520 |

FOREIGN PATENT DOCUMENTS

| | | |
|---|---|---|
| 63-1753 | 6/1986 | Japan . |
| 3-286165 | 12/1991 | Japan . |

*Primary Examiner*—Vincent N. Trans
*Attorney, Agent, or Firm*—Oliff & Berridge

[57] ABSTRACT

A system, capable of determining an engine abnormality, is disclosed. The engine includes a first regulator for controlling air fuel ratio and a second regulator for controlling the purging amount of fuel vapor into an air-intake passage from a fuel tank. The variance in the purging amount effects the air fuel ratio. An engine control unit computes a parameter value used to control the air fuel ratio based on a signal from a detector which detects the operational condition of the engine, and controls the first regulator with the computed parameter value to allow the operational condition of the engine to approach a requested condition. A determining apparatus determines that an abnormality has occurred in the engine when the parameter value computed by the control unit continuously deviates from a predetermined numerical range for a predetermined period of time. The determining apparatus also automatically adjusts the numerical range in accordance with a degree of influence of the variance in the purging amount on the air fuel ratio.

20 Claims, 7 Drawing Sheets

APPARATUS FOR DETERMINING ENGINE ABNORMALITY

BACKGROUND OF THE INVENTION

1. Field of the Invention

The present invention relates to an abnormality determining apparatus for an engine. More particularly, this invention relates to an apparatus which determines the existence of an abnormality in the fuel supply system of an engine when a parameter value used for feedback control of the fuel air ratio of the engine continuously satisfies a predetermined condition for a predetermined period of time.

2. Description of the Related Art

Japanese Unexamined Patent Publication No. 63-1753 discloses a conventional abnormality determining apparatus for a fuel air ratio control system for a motor vehicle engine. The disclosed engine system is provided with an apparatus for absorbing fuel vapor in a fuel tank, and a fuel vapor purge passage for connecting the absorbing apparatus to an air-intake passage. A valve for controlling the purging of fuel is disposed in the purge passage. The fuel vapor absorbing apparatus inhibits fuel vapor in the fuel tank from being discharged in the air. The purge passage supplies the fuel, collected by the absorbing apparatus, to the air-intake passage. Based on the output signal of an exhaust gas sensor disposed in an exhaust passage of the engine, an engine control unit performs feedback control of the fuel air ratio.

According to the conventional abnormality determining apparatus, when the feedback value of the fuel air ratio continuously exceeds a predetermined limit for a first predetermined period of time, the purge control valve is temporarily closed to block the purge passage. In addition, the control unit starts measuring the time since the closing of the purge control valve. When the feedback value continuously exceeds the predetermined limit value for a second predetermined period of time, even with the purge passage blocked, the control unit determines that an abnormality has occurred in the fuel air ratio control system. This method of diagnosing the fuel air ratio eliminates the need to consider the effects of purging the fuel vapor from the fuel delivery system. Even if the feedback value of the fuel air ratio exceeds the predetermined limit value due to the influence of the fuel vapor purging, engine abnormalities can be detected without error. According to the conventional art, however, the purge control valve is temporarily closed during the diagnosis of the fuel air ratio control system. This effectively prevents fuel vapor purging from being executed during the diagnosis. When the purge control value closes, vapor pressure continually builds up in the fuel tank causing an unavoidable discharge of fuel vapor from the fuel tank to the atmosphere.

To overcome this shortcoming, the process of determining whether abnormalities exist in the fuel air ratio control system may be suspended during fuel vapor purging. This would eliminate the need to consider the influence which the fuel vapor purge has on the diagnosis of the fuel system. This would also prevent fuel vapor from being discharged into the air during fuel vapor purging. According to this method, however, it is impossible to properly diagnose an abnormality in the fuel air ratio control system during the fuel vapor purging. This in turn substantially reduces the accuracy or reliability of diagnosing engine condition abnormalities.

SUMMARY OF THE INVENTION

Accordingly, it is a primary objective of the present invention to provide an engine abnormality determining apparatus, which will accurately determine an engine abnormality without interrupting specific engine operations such as fuel vapor purging.

To achieve the foregoing and other objects and in accordance with the purpose of the present invention, an improved engine system is provided, which includes an apparatus for diagnosing an engine abnormality.

Engine operation is, according to the present invention, represented as a plurality of controlled variables associated with the engine operation. The engine system according to the present invention comprises at least one condition detector for detecting an operational condition of the engine and outputting a signal indicative of the detection result, a first regulator for manipulating a first controlled variable, and a second regulator for manipulating a second controlled variable. The variance in the second controlled variable, caused by the second regulator, affects the first control variable. The engine system further includes a control unit both for computing a parameter value used to control the first control variable based on a signal from the condition detector, and for controlling the first regulator with the computed parameter value. This allows the operational condition of the engine to most closely approach that requested by the driver.

The engine system incorporates an apparatus for determining an abnormality in the operation of the engine. The determining apparatus determines that an abnormality has occurred in the engine, when the parameter value computed by the control unit continuously falls off a predetermined numerical range over a predetermined period of time (T1). The apparatus further includes a range adjusting device for automatically adjusting the numerical range in accordance with a degree of influence of the variance in the second controlled variable on the first controlled variable.

It is preferable in the engine system of the present invention that the first controlled variable is an fuel air ratio of an fuel air mixture supplied to the engine, and the second controlled variable is a purging amount of fuel vapor, produced in a fuel tank, supplied into an air-intake passage of the engine. Even if the second controlled variable changes due to the purging of fuel vapor into the air-intake passage from the fuel tank in this case, the range adjusting device automatically and properly alters the numerical range to determine an abnormality while considering the change in second controlled variable. The automatic setting of the numerical range permits the engine system to accurately determine an abnormality without interrupting the control on the second controlled variable.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

Figure 1:
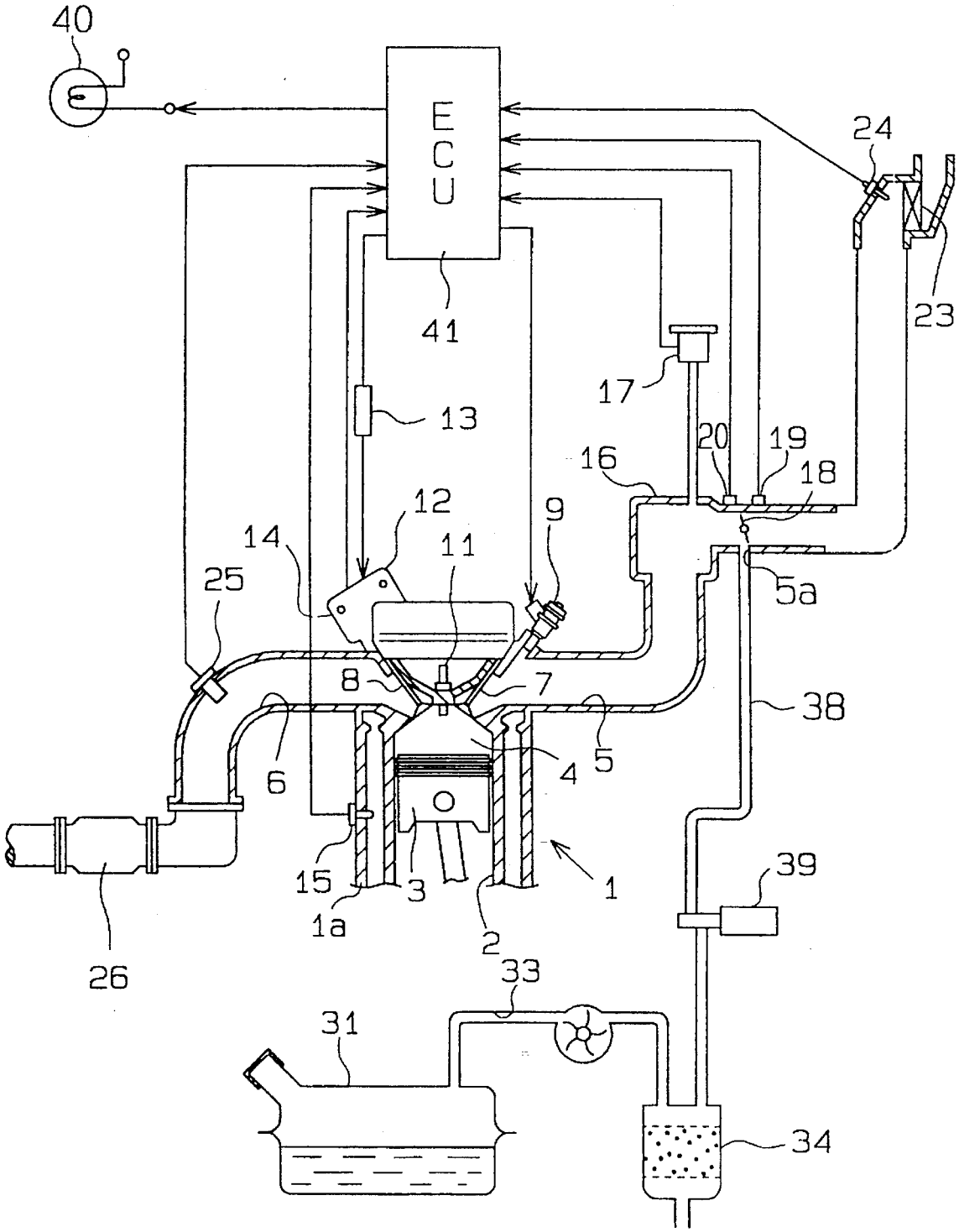
FIG. 1 is a schematic diagram illustrating a diagnostic apparatus to detect engine abnormalities according to the present invention.

An abnormality determining apparatus for an engine system according to one embodiment of the present invention will now be described referring to the accompanying drawings. As shown in FIG. 1, this embodiment is adapted for use in a multicylinder engine 1 for an automobile.

The engine 1 has a plurality of cylinders 2 (only one shown), each having a piston 3 with a combustion chamber 4 defined above the piston 3. Each combustion chamber 4 is connected to an air-intake passage 5 and an exhaust passage 6. Each cylinder 2 has an intake valve 7 that controls the communication between the combustion chamber 4 and air-intake passage 5, and an exhaust valve 8 that controls communication between the combustion chamber 4 and exhaust passage 6. A mixture of air from the air-intake passage 5 and fuel injected by an injector 9 is supplied via the intake valve 7 to each combustion chamber 4.

Each cylinder 2 of the engine 1 is provided with an ignition plug 11 that receives a voltage signal supplied by an igniter 13 via a distributor 12. Ignition timing of each ignition plug 11 is determined in accordance with the crank angle of the engine 1. The mixture exploded in the combustion chamber 4 by the associated ignition plug 11 is discharged as exhaust gas to the exhaust passage 6 via the exhaust valve 8.

The distributor 12 is equipped with a typically constructed rotor (not shown) and an engine speed sensor 14 which detects the rotation of the rotor and outputs a signal indicative of the number of rotations of the engine or the engine speed. A coolant temperature sensor 15 is attached to a cylinder block 1*a* of the engine 1 to detect the temperature of the coolant (THW) of the engine 1.

A surge tank 16 for suppressing the pulsation of the intake air is disposed midway in the air-intake passage 5. The surge tank 16 is coupled to a diaphragm type pressure sensor 17 which detects the manifold pressure (PM). A throttle valve 18, which is provided at the upstream side of the surge tank 16, changes its angle in responsive to the manipulation of an accelerator pedal (not shown). The amount of air taken into the air-intake passage 5 is controlled in accordance with a change in the angle of the throttle valve 18.

A throttle sensor 19 and an idle switch 20 are provided in the vicinity of the throttle valve 18. The throttle sensor 19 detects the angle TA of the throttle valve 18. The idle switch 20 is activated on when the throttle valve 18 fully blocks the air-intake passage 5, and remains off otherwise. An air cleaner 23 is disposed at the upstream side of the air-intake passage 5. An air temperature sensor 24, provided near the air cleaner 23, is provided for detecting the air temperature THA.

The exhaust passage 6 is provided with both an oxygen sensor 25 for detecting the oxygen density in the exhaust gas and a three way catalytic converter 26 for purifying the exhaust gas (including HC, CO and $NO_x$).

A fuel tank 31 of the vehicle is connected via a vapor passage 33 through which fuel vapor in tank 31 is provided to a canister 34. The canister 34 is a container which contains activated carbon that temporarily absorbs vaporized fuel. A sensing port 5*a* is formed in the air-intake passage 5 near the throttle valve 18. The canister 34 is connected via a purge passage 38 to the sensing port 5*a* so that fuel vapor in the canister 34 can be provided to the engine 1. A purge control valve 39 is disposed midway in the purge passage 38 to regulate the amount fuel vapor supplied from the canister 34 to the air-intake passage 5. In this embodiment, the purge control valve 39 is of a bimetal type and is self-activated in accordance with the coolant temperature. When the coolant temperature THW is lower than a predetermined temperature A1, the purge control valve 39 is closed to block the purge passage 38. When the coolant temperature THW is equal to or higher than the predetermined temperature A1, the purge control valve 39 is opened. An orifice (not shown) is normally provided in the purge passage 38 to prevent negative pressure in the air-intake passage 5 from directly affecting the fuel tank 31.

Figure 2:
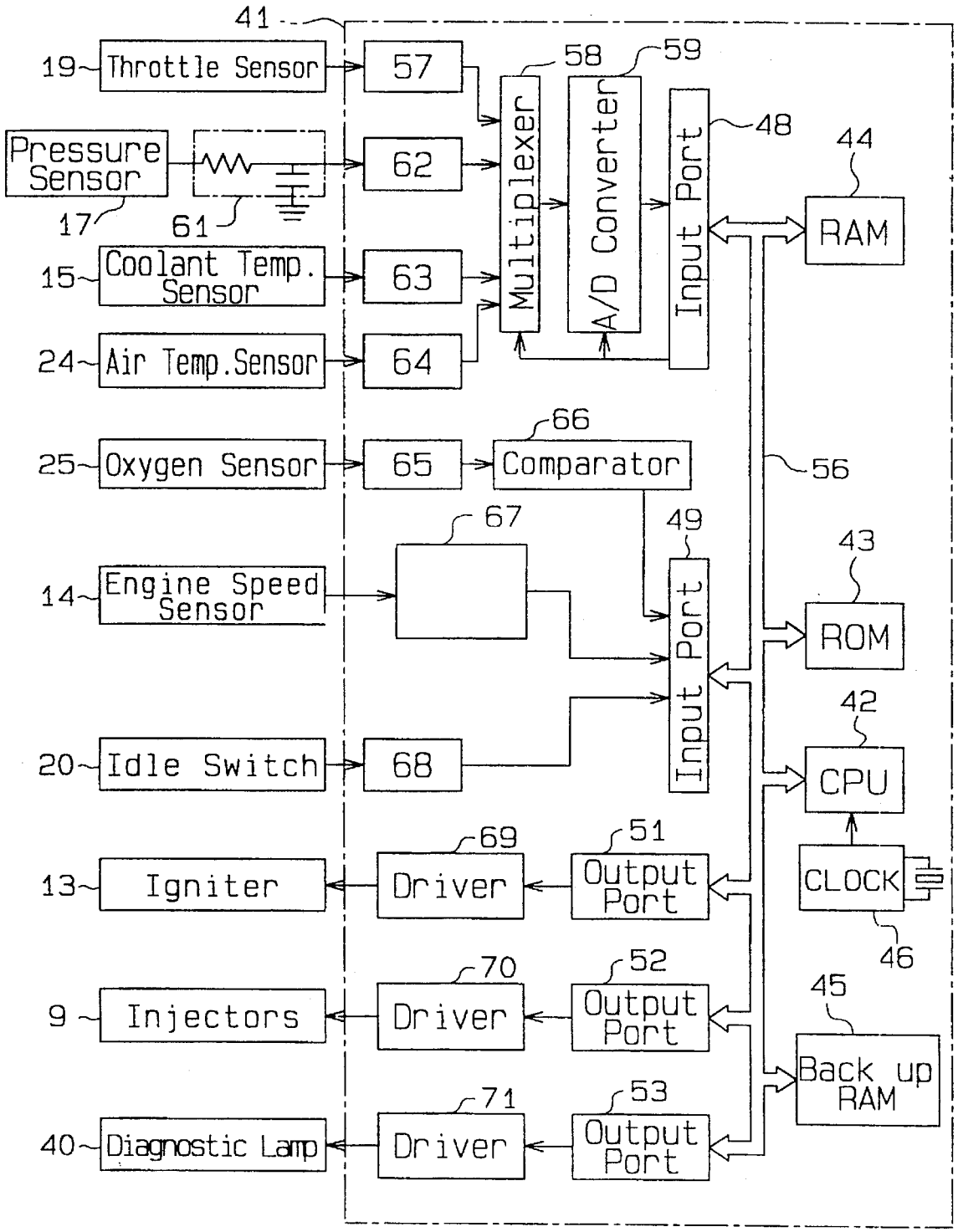
FIG. 2 is a block diagram showing the electric components of the abnormality detecting apparatus.

An instrument panel (not shown) at the driver's seat is provided with a diagnostic lamp 40 which informs the driver of an abnormality in the fuel supply system. As shown in FIG. 2, the engine speed sensor 14, coolant temperature sensor 15, pressure sensor 17, throttle sensor 19, idle switch 20, air temperature sensor 24 and oxygen sensor 25, all of which are devices for detecting the conditions of the vehicle, are electrically connected to the input side of an electronic control unit (ECU) 41. The injectors 9, the igniter 13 and the diagnostic lamp 40 are electrically connected to the output side of the ECU 41 and are controlled by this ECU 41.

As shown in FIG. 2, the ECU 41 comprises a central processing unit (CPU) 42, a read only memory (ROM) 43, a random access memory (RAM) 44, a backup RAM 45, a clock generator 46, input ports 48 and 49, and output ports 51, 52 and 53, all of which are connected together by a bus 56. Control programs necessary for the CPU 42 to execute operations and initial data are previously stored in the ROM 43. The CPU 42 performs various operations according to those control programs. The RAM 44 temporarily stores the results of the operations performed by the CPU 42. The backup RAM 45 is backed up by a battery to hold data about engine operation results even when the power supply is deactivated. The clock generator 46 supplies a master clock signal to the CPU 42.

A throttle angle signal from the throttle sensor 19, indicative of the throttle angle, is input to the input port 48 via a buffer 57, a multiplexer 58 and an A/D converter 59. A signal from the pressure sensor 17 is input to the input port 48 via a filter 61, a buffer 62, the multiplexer 58 and the A/D converter 59. A signal from the coolant temperature sensor 15 is input to the input port 48 via a buffer 63, the multiplexer 58 and the A/D converter 59. A signal from the air temperature sensor 24 is input to the input port 48 via a buffer 64, the multiplexer 58 and the A/D converter 59. The multiplexer 58 selectively outputs the throttle angle signal, pressure signal, coolant temperature signal and air temperature signal to the A/D converter 59. The filter 61 filters out the component in the signal from the pressure sensor 17 which originates from the pulsation of the pressure in the air-intake passage 5.

A signal from the oxygen sensor 25, which represents the oxygen density, is input to the input port 49 via a buffer 65 and a comparator 66. A signal from the engine speed sensor 14, indicative of the engine speed, is input to the input port 49 via a wave shaper 67. An ON/OFF signal from the idle switch 20 is input via a buffer 68 to the input port 49.

Based on the signals received via the input ports 48 and 49, the CPU 42 detects the throttle angle TA, the manifold pressure PM, the coolant temperature THW, the air temperature THA, the fuel mixture (rich/lean) status, the engine speed NE and the ON/OFF status of the idle switch 20. The CPU 42 controls the igniter 13, injectors 9 and diagnostic lamp 40 via the output ports 51 to 53 and drivers 69 to 71.

The ECU 41 also performs feedback control on the fuel air ratio. For the purpose of this feedback control, the CPU 42 computes and updates various parameters (such as a fuel air ratio feedback value FAF, fuel air ratio learning value KG and other compensation values).

Figure 3:
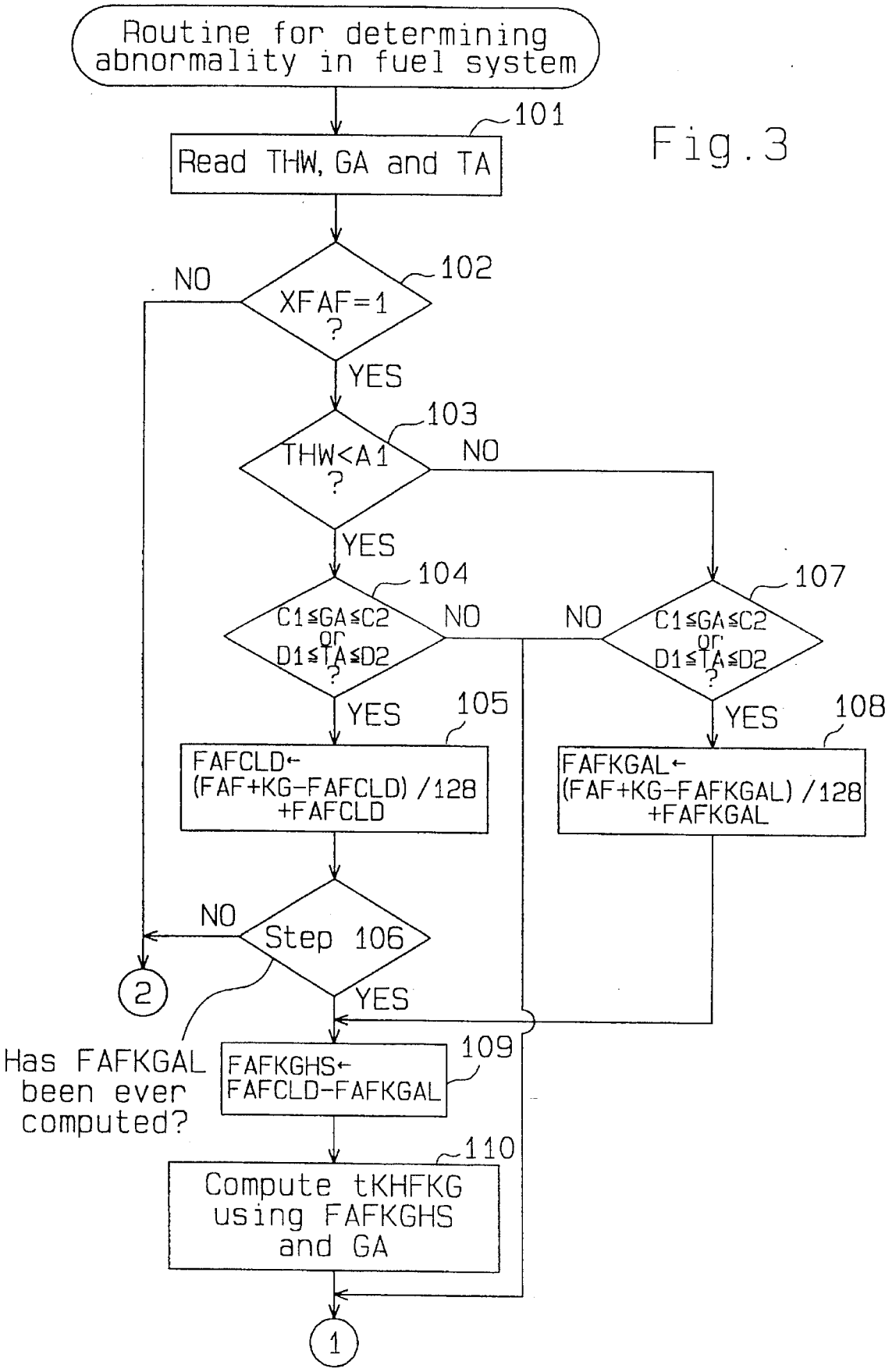
FIGS. 3 and 4 present a flowchart illustrating a "routine executed by a CPU for determining a fuel supply system abnormality"
Figure 4:
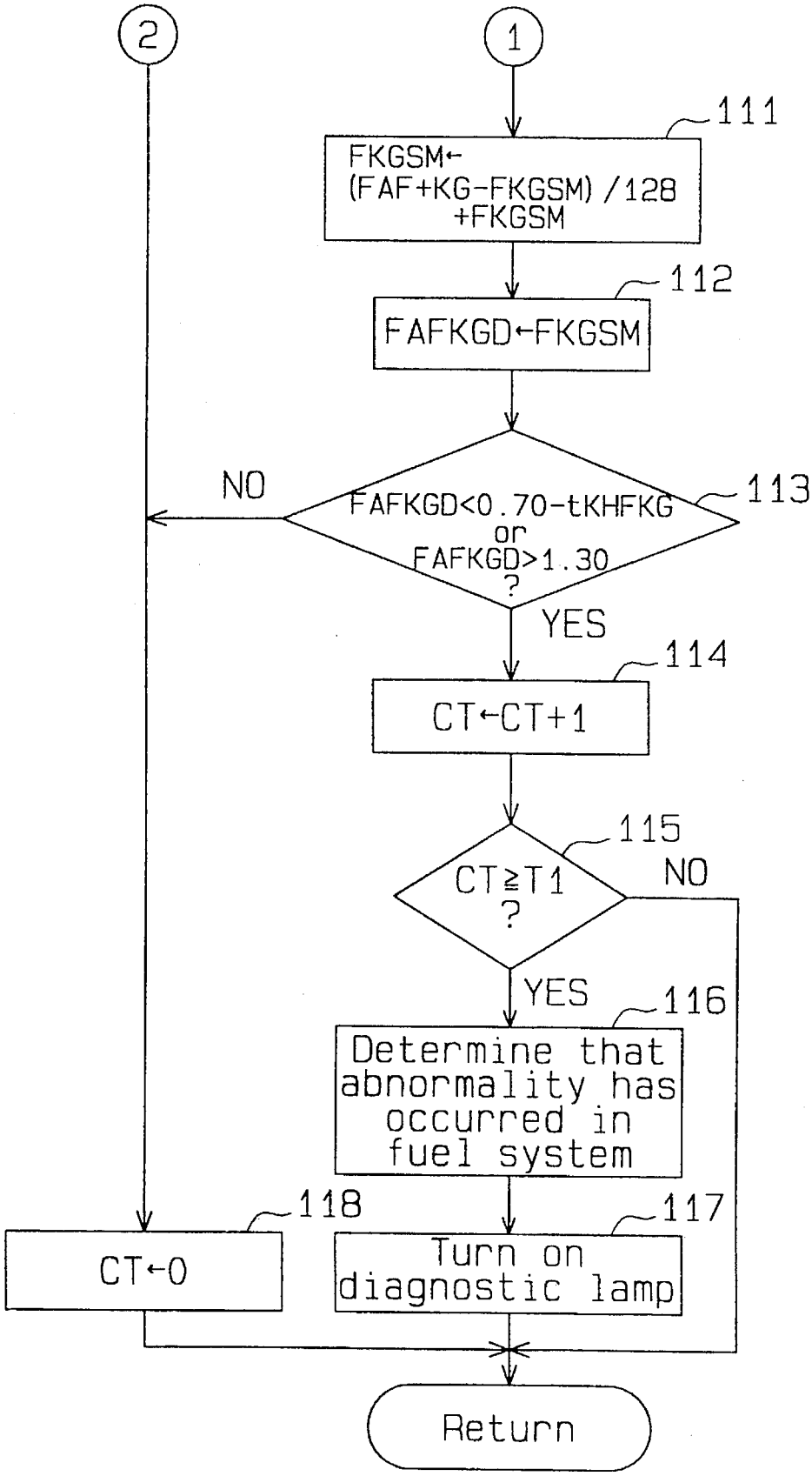

The function of the abnormality determining apparatus according to this embodiment will be described below. FIGS. 3 and 4 illustrate a control flow routine which is periodically executed by a CPU 42 to determine the occurrence of an abnormality in the fuel supply system.

When the routine starts, the CPU 42 reads the coolant temperature THW, the amount of intake air GA and the throttle angle TA based on the output provided by the coolant temperature sensor 15, engine speed sensor 14, pressure sensor 17 and throttle sensor 19 (step 101). (The amount of intake air GA is computed based on the manifold pressure PM and engine speed NE.)

The CPU 42 manages an fuel air ratio control flag XFAF, which is set by a fuel air ratio control program different from the abnormality determining routine shown in FIGS. 3 and 4. In step 102, as shown in FIG. 3, the CPU 42 determines whether the flag XFAF is "1", indicating that the fuel air ratio control is currently being executed, or whether the flag is 0 indicating that the control is not being executed. When the flag XFAF is "1", the fuel air ratio control is in progress and the current routine advances to step 103.

The CPU 42 determines if the current coolant temperature THW is lower than the predetermined temperature A1 (step 103). When the condition in step 103 is satisfied, it means that the engine temperature is still low and the purge control valve 39 is not yet opened. In this case, the current routine moves to step 104.

Figure 5:
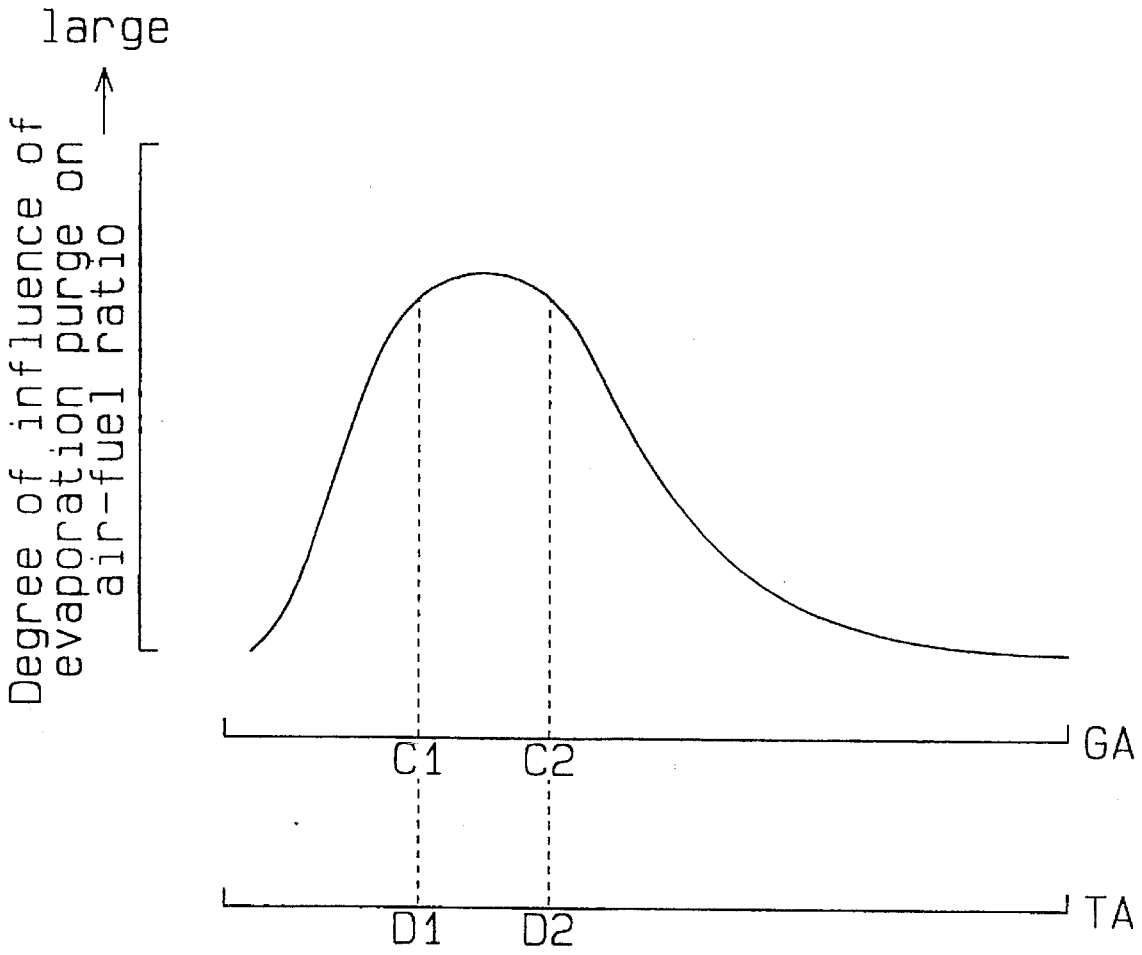
FIG. 5 is a graph showing the relation among the amount of intake air (GA), a throttle angle (TA) and the influence of fuel vapor purging on the fuel air ratio.

At step 104, the CPU 42 selectively checks two conditions. The first condition is whether the current amount of the intake air GA is between a first predetermined amount C1 and a second predetermined amount C2. The second condition is whether the current throttle angle TA is between a first predetermined angle D1 and a second predetermined angle D2. When either one of the two conditions is met, the current engine condition is readily affected by the fuel vapor purging (hereinafter referred to as "vapor purge") during the setting of the fuel air ratio. FIG. 5 schematically illustrates the relation among the amount of intake air GA or the throttle angle TA as well as the influence of the vapor purge on the fuel air ratio. As shown in FIG. 5, the influence of the evaporation purge is maximized when the amount of intake air GA lies between the predetermined amounts C1 and C2 or when the throttle angle TA lies between the predetermined angles D1 and D2. When the amount of intake air GA or the throttle angle TA lies in the associated range, the CPU 42 performs steps 105 and 106.

In step 105, as shown in FIG. 3, the CPU 42 subtracts a compensation value FAFCLD, computed in the previous cycle, from the sum of the fuel air ratio feedback value FAF and the fuel air ratio learning value KG, and divides the difference by "128". The CPU 42 then adds the resulting quotient to the compensation value FAFCLD, computed in the previous cycle, and sets the sum as a new compensation value FAFCLD. The feedback value FAF is a target value for the fuel air ratio feedback control, and the learning value KG is one of control parameters which are properly updated based on the fuel air ratio control program. The compensation value FAFCLD is one of the compensation values used to control the fuel air ratio when the engine is still cool. When the engine is activated, the compensation value FAFCLD is initialized to "1.0".

In step 106, the CPU 42 determines whether or not a compensation value FAFKGAL has been computed. The compensation value FAFKGAL is one of the compensation values used to control the fuel air ratio. When the compensation value FAFKGAL has been computed, the current routine proceeds to step 109.

When the condition at step 103 is not satisfied, it indicates that the purge control valve 39 is open. In this case, the current routine proceeds to step 107 where the CPU 42 checks for two conditions. The first condition is whether the current amount of intake air GA is between the first predetermined amount C1 and the second predetermined amount C2. The second condition is whether the current throttle angle TA is between the first predetermined angle D1 and the second predetermined angle D2. When either one of the two conditions is met, the CPU 42 resets the fuel air ratio FAFKGAL in step 108. Specifically, the CPU 42 subtracts the compensation value FAFKGAL, computed in the previous cycle, from the sum of the fuel air ratio feedback value FAF and the fuel air ratio learning value KG, and divides the difference by "128". The CPU 42 then adds the quotient to the compensation value FAFKGAL computed in the previous cycle, and sets the sum as a new compensation value FAFKGAL. When the engine is activated, the compensation value FAFKGAL is initialized to "0.5". Following this, the current routine proceeds to step 109.

When neither the first condition nor the second condition is met at steps 104 or 107, it indicates that the engine operation would only insignificantly be affected by the vapor purge in the fuel air ratio control. In such a case, the current routine proceeds to step 111 shown in FIG. 4.

Following the procedure at step 108, the CPU at step 109 subtracts the compensation value FAFKGAL from the compensation the cold engine value FAFCLD to compute an evaporation compensation coefficient FAFKGHS. This evaporation compensation coefficient FAFKGHS is considered as a compensated variable numerically representing the influence of the vapor purge on the fuel air ratio control. The coefficient FAFKGHS is also used to in the separate routine for controlling the fuel air ratio.

In step 110, the CPU 42 computes a vapor compensation tKHFKG amount based on the newly set vapor compensation coefficient FAFKGHS and the current amount of intake air GA. This is done referring to a three-dimensional data map which shows the relationship among FAFKGHS, GA and tKHFKG.

In step 111 following step 104, step 107 or step 110, the CPU 42 sets a compensation value FKGSM again used in the fuel air ratio control program to effect a gradual change in the fuel air ratio feedback value FAF. The CPU 42 subtracts the compensation value FKGSM, computed in the previous cycle, from the sum of the fuel air ratio feedback value FAF and the fuel air ratio learning value KG. The CPU 42 then divides the computed difference by 128 and adds the resulting quotient to the compensation value FKGSM computed in the previous cycle. The resultant sum is then set as a new compensation value FKGSM. The compensation value FKGSM is initialized to "1.0" when the engine is activated.

At step 112, the CPU 42 sets the latest compensation value FKGSM as an offset value FAFKGD. In step 113, the CPU 42 determines whether a third or a fourth condition has been met. The third condition is met when the new offset value FAFKGD is smaller than the evaporation compensation amount tKHFKG less "0.70". The fourth condition is met when the correction value FAFKGD is larger than "1.30". The evaporation compensation amount tKHFKG less "0.70", corresponds to the set lower limit FAFKGD value while the "1.30" value corresponds to the set upper limit FAFKGD value. In other words, the CPU 42 determines whether the particular value for FAFKGD lies in the numerical range defined by its upper and lower limit values.

When the third determining condition is satisfied, the fuel air ratio is determined to be too close to a fuel rich condition status. This may indicate that an abnormality exists, for example that the injector 9 cannot stop injecting fuel or that the engine's combustion pressure is abnormally high. When the fourth determining condition is met, on the other hand, the current routine determines that the fuel air ratio is too close to a lean fuel condition. This may be the case for example when injector 9 undergoes choking. That is, when the third or fourth determining condition is met, some kind of abnormality may have occurred in the fuel supply system. In this case, the flow proceeds to step 114.

At step 114, the CPU 42 increments a count value CT by "1" to accomplish software-based time counting. In the next step 115, the CPU 42 determines if the count value CT exceeds a predetermined time T1. When the count value CT has not exceeded the predetermined time T1, the abnormality determining routine is terminated without executing the subsequent processes. When the count value CT exceeds the predetermined time T1, the CPU 42 determines that an abnormality has occurred in the fuel supply system (step 116) and turns on the diagnostic lamp 40 (step 117) before terminating the abnormality determining routine.

When the routine determines that the fuel air ratio control flag XFAF is not "1" at step 102, or that the fuel air ratio compensation value FAFKGAL has not been computed at step 106, or finally that neither the third nor fourth conditions have been satisfied at step 113, then the current routine determines that no abnormality has been detected in the fuel supply system. In this case, the flow proceeds to step 118 where the CPU 42 sets the count value CT to "0" and terminates the abnormality determining routine.

According to this embodiment, when the correction value FAFKGD is smaller than 0.70, less the evaporation compensation amount tKHFKG, or when FAFKGD is greater than 1.30, the CPU 42 provisionally considers that some sort of abnormality has occurred in the fuel supply system. When this state continues over a predetermined time T1, the CPU 42 finally determines that some sort of abnormality has occurred in the fuel supply system, and turns on the diagnostic lamp 40.

When the purge control valve 39 is open and evaporation purge affects the control on the fuel air ratio, the fuel air ratio may shift to the fuel rich side causing the correction value FAFKGD to decrease. Should the correction value FAFKGD decrease below "0.70", the abnormality determining apparatus determines that an abnormality has occurred in the fuel supply system. According to this embodiment, however, the set lower limit value used for the determination at step 113 is set to a value smaller than "0.70" by the evaporation compensation amount tKHFKG. Should it be possible for the vapor purge to influence the fuel air ratio control, the value set for the determination of an abnormality is automatically changed to a smaller value in accordance with the degree of the influence. This prevents the correction value FAFKGD from becoming lower than the set lower limit value due to the influence of the evaporation purge. Consequently, during the diagnosis of the fuel supply system, the fuel vapor in the fuel tank is prevented from being discharged to the outside without interrupting to the fuel vapor purging process. In addition, the diagnosis of the fuel supply system remains unaffected by the vapor purge and is performed without interruption, thus ensuring a high degree of diagnostic precision.

Figure 6:
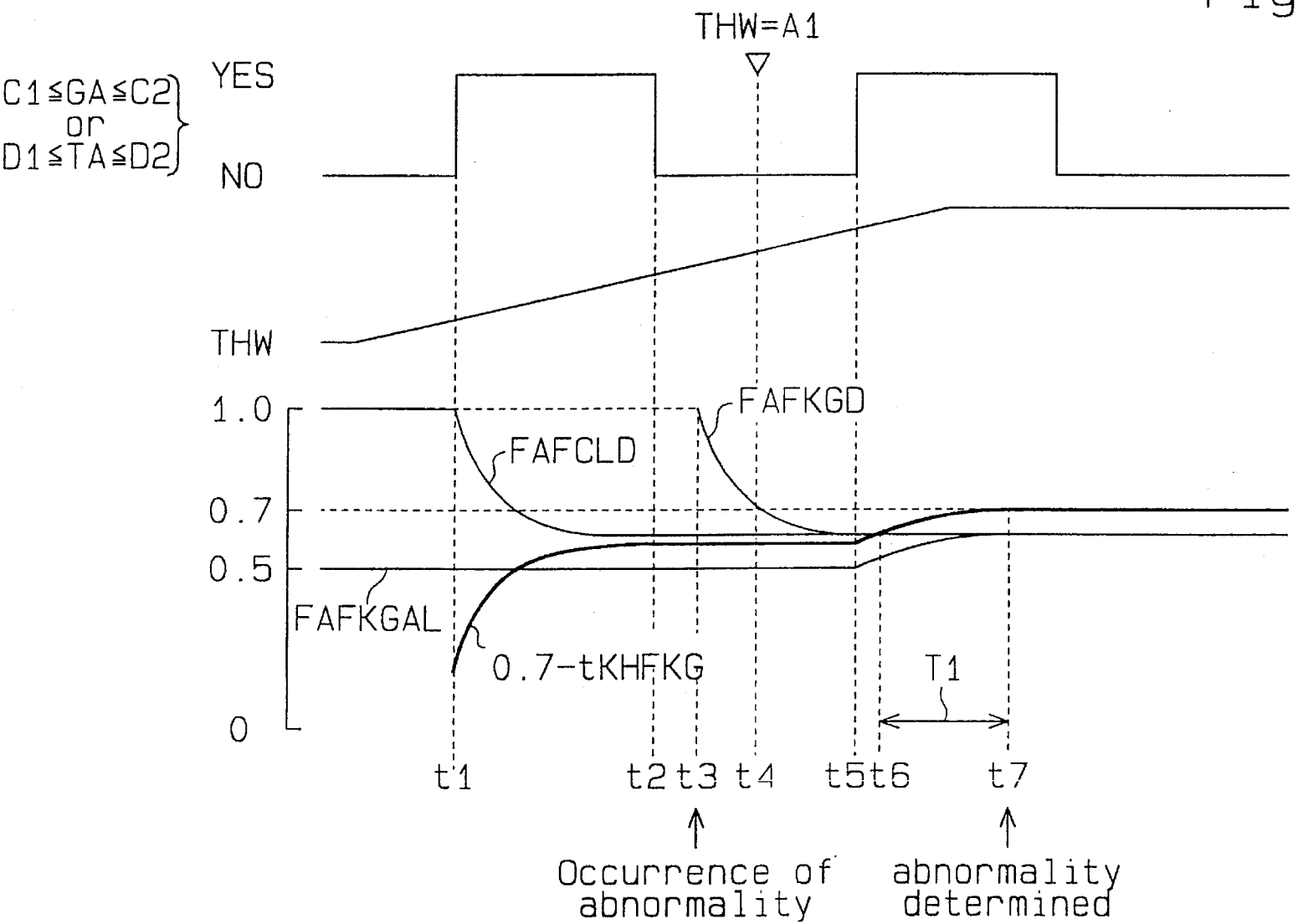
FIG. 6 is a timing chart, showing the relation among various parameters with respect to time, that further explains the function of the abnormality determining apparatus illustrated in FIGS. 1 and 2.

An example of an abnormality diagnosis will now be discussed with reference to the timing chart given in FIG. 6. First (before timing t1), it is assumed that the fuel air ratio compensation value FAFCLD for the cool engine is set to "1.0" and the fuel air ratio compensation value FAFKGAL is set to "0.5". In this case, the evaporation compensation amount tKHFKG is a relatively large value (e.g., around 0.4) and the set lower limit value (0.70—tKHFKG) is a relatively low value (e.g., around 0.3).

At timing t1, the coolant temperature THW is still lower than the predetermined temperature A1, and the amount of intake air GA satisfies either conditions of step 104, i.e., that GA is greater than C1 and smaller than C2 or that the throttle angle TA is between the predetermined angles D1 and D2. After the timing t1, the fuel air ratio compensation cool engine value FAFCLD gradually decreases as a result of the computation in step 105 in FIG. 3. The evaporation compensation amount tKHFKG becomes gradually smaller with a decrease in FAFCLD (this presumes that the evaporation compensation amount tKHFKG is unaffected by the amount of intake air GA, etc). The decrease in tKHFKG is coincident with an increase in the set lower limit value (0.70—tKHFKG).

Suppose, for example, that at timing t2 the vehicle's operating conditions are such that the influence of evaporation purge on the fuel air ratio control is very small. This would be the case were the diagnostic routine to produce a negative determination at step 104. Were this condition to be maintained, the set lower limit value (0.70—tKHFKG) would remain constant following time t2. Were some kind of abnormality to occur in the fuel supply system at timing t3, the correction value FAFKGD would gradually decrease after t3 as a result of the computations performed at steps 111 and 112 in FIG. 4.

When the coolant temperature THW reaches the predetermined temperature A1 at time t4, the CPU 42 makes a negative decision "NO" at step 103. When the influence of evaporation purge increases again at time t5 a positive determination results from the operation performed at step 107, and the fuel air ratio compensation value FAFKGAL gradually increases based on the result of the computation performed at step 108. The compensation values FAFCLD and FAFKGAL will both approach the correction value FAFKGD as long as those operations continue.

When the correction value FAFKGD decreases below the set lower limit value (0.70—tKHFKG) at timing t6, the CPU 42 starts measuring the time (steps 113 and 114). When the correction value FAFKGD is kept lower than the lower limit value until time t7 (which is set as a predetermined time T1 after the timing t6) the CPU 42 determines that an abnormality has occurred in the fuel supply system (steps 115 and 116).

Figure 7:
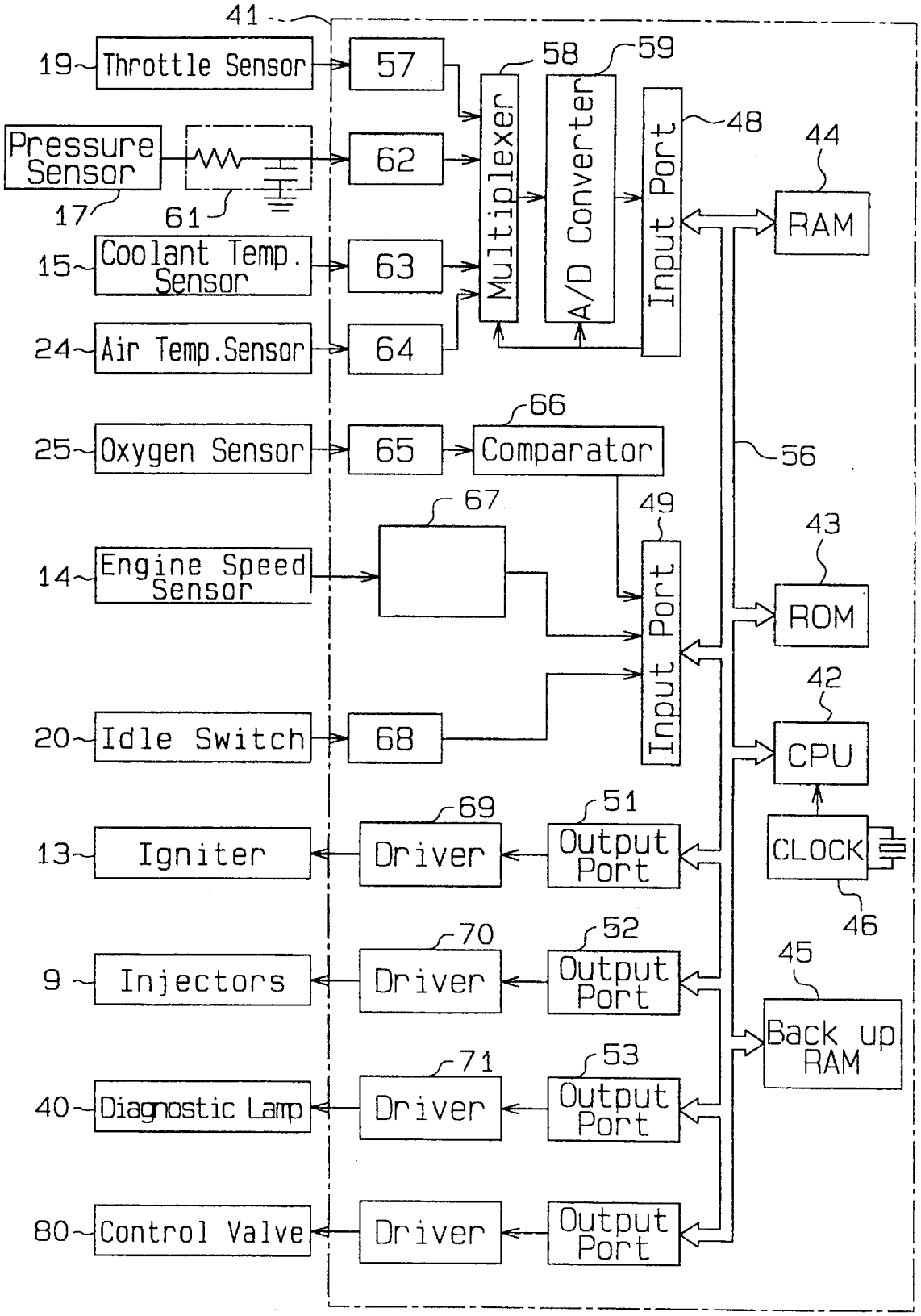
FIG. 7 is a block diagram showing a modified version of the abnormality determining apparatus.

Although only one embodiment of the present invention has been described herein, it should be apparent to those skilled in the art that the present invention may be embodied in many other specific forms without departing from the spirit or scope of the invention. Particularly, it should be understood that the bimetal type purge control valve 39, which is self-activated in accordance with the coolant temperature, may be replaced with a control valve 80 as shown in FIG. 7. This control value 80 is controlled by the ECU 41 based on the data from the coolant temperature sensor 15.

Although the above-described embodiment is a specific example of the abnormality determining apparatus adapted for use in the engine system that performs the operation of vapor purging carries out evaporation purge, the present invention may also be adapted for use in an engine system which performs other control operations (such as recirculation of exhaust gas or secondary air supply) affecting the fuel air ratio control.

While the present invention is associated with the fuel air ratio control in the above embodiment, this invention may be associated with other controls such as control of the fuel injection timing.

Therefore, the present examples and embodiment are to be considered as illustrative and not restrictive and the invention is not to be limited to the details given herein, but may be modified within the scope of the appended claims.

What is claimed is:

1. An engine system capable of diagnosing an occurrence of malfunction in engine operation represented as a plurality of controlled variables associated with the engine operation, the engine system comprising:

condition detecting means for detecting an operational condition of the engine and for outputting a signal indicative of the detection result;

first regulating means for regulating a first controlled variable;

first control means for computing a parameter value used to control said first controlled variable based on the signal from said condition detecting means, and for controlling said first regulating means with said computed parameter value to allow said operational condition of the engine to approach a requested condition;

second regulating means for regulating a second controlled variable, wherein the variance of the second controlled variable affects said first controlled variable;

determining means for determining whether the engine is properly functioning, said determining means determining that an abnormality has occurred in the engine when said parameter value computed by said first control means is continuously outside a predetermined numerical range over a predetermined period of time; and range adjusting means for automatically adjusting said numerical range in accordance with a degree of influence of the variance in said second controlled variable on said first controlled variable.

2. The engine system according to claim 1, wherein said first controlled variable is a fuel air ratio of a fuel air mixture supplied to the engine;

wherein said first regulating means regulates said fuel air ratio; and wherein said first control means includes a control unit for performing feedback control on said fuel air ratio regulating means to permit said fuel air ratio to approach a requested fuel air ratio.

3. The engine system according to claim 2, wherein said first regulating means includes an injector for injecting fuel into an air-intake passage of the engine.

4. The engine system according to claim 2, wherein said second controlled variable is a purging amount of fuel vapor produced in a fuel tank and purged into an air-intake passage of the engine; and wherein said second regulating means includes a vapor communication passage for connecting said air-intake passage to said fuel tank, and a purge control valve provided along said vapor communication passage.

5. The engine system according to claim 4, wherein said purge control valve is a bimetal type valve which is self-activated itself in accordance with a temperature of a coolant of the engine.

6. The engine system according to claim 1, further comprising second control means for controlling said second regulating means based on the signal received from said condition detecting means.

7. The engine system according to claim 6, wherein said second controlled variable is a purging amount of fuel vapor produced in a fuel tank and purged into an air-intake passage of the engine;

wherein said second regulating means includes a vapor communication passage for connecting said air-intake passage to said fuel tank, and a control valve provided along said vapor communication passage; and wherein said second control means includes a control unit for performing feedback control on said control valve.

8. The engine system according to claim 1, wherein said condition detecting means includes at least one component selected from a group that includes an engine speed sensor, a coolant temperature sensor, a pressure sensor, a throttle sensor, an idle switch and an air temperature sensor.

9. The engine system according to claim 1, wherein said numerical range is defined by an upper limit value and a lower limit value, and wherein at least one of said upper and lower limit values is allowed to be variable by said range adjusting means.

10. The engine system according to claim 9, wherein said determining means includes:

means for comparing said parameter value computed by said first control means with said upper and lower limit values to determine whether said parameter value falls within said numerical range; and means for measuring a time during which said parameter value does not lie in said numerical range and for comparing the measured time with said predetermined time.

11. An apparatus for determining the occurrence of malfunction in the operation of an engine represented as a plurality of controlled variables associated with the engine operation, first regulating means for regulating a first controlled variable, second regulating means for regulating a second controlled variable, the variance of the second controlled variable affecting the first controlled variable, condition detecting means for detecting an operational condition of the engine and for outputting a signal indicative of the detection result, and control means for computing a parameter value used to control the first controlled variable based on the signal from the condition detecting means and for controlling the first regulating means with the computed parameter value to allow the operational condition of the engine to approach a requested condition, the apparatus comprising:

determining means for determining whether the engine is properly functioning, said determining means determining that an abnormality has occurred in the engine when the parameter value computed by the control means is continuously outside a predetermined numerical range over a predetermined period of time; and range adjusting means for automatically adjusting said numerical range in accordance with a degree of influence of the variance in the second controlled variable on the first controlled variable.

12. The apparatus according to claim 11, wherein said numerical range is defined by an upper limit value and a lower limit value, and wherein at least one of said upper and lower limit values is allowed to be variable by said range adjusting means.

13. The apparatus according to claim 12, wherein said determining means includes:

means for comparing the parameter value computed by the control means with said upper and lower limit values to determine whether said parameter value falls within said numerical range; and means for measuring a time during which said parameter value does not lie in said numerical range and for comparing said measured time with said predetermined period of time.

14. The apparatus according to claim 11, wherein said first controlled variable is an fuel air ratio of an fuel air mixture supplied to the engine; and wherein said second controlled variable is a purging amount of fuel vapor produced in a fuel tank and purged into an air-intake passage of the engine.

15. An engine system capable of diagnosing an occurrence of malfunction in engine operation represented as a plurality of controlled variables associated with the engine operation, the engine system comprising:

a condition detecting device that detects an operational condition of the engine and outputs a signal indicative of the detection result;

a first regulating device connected to the condition detecting device that regulates a first controlled variable;

a first controlled device connected to the condition detecting device that computes a parameter value used to control the first controlled variable based on the signal from the condition detecting device, and that controls the first regulating device with the computed parameter value to allow the operational condition of the engine to approach a requested condition;

a second regulating device connected to the condition detecting device that regulates a second controlled variable, wherein the variance of the second controlled variable affects the first controlled variable;

a determining device connected to the condition detecting device that determines whether the engine is properly functioning, the determining device determining that an abnormality has occurred in the engine when the parameter value computed by the first control device is continuously outside a predetermined numerical range over a predetermined period of time; and a range adjusting device connected to the condition detecting device that automatically adjusts the numerical range in accordance with a degree of influence of the variance in the second control variable on the first controlled variable.

16. The engine system according to claim 15, wherein the first controlled variable is a fuel air ratio of a fuel air mixture supplied to the engine;

wherein the first regulating device includes a fuel air ratio regulating device that regulates the fuel air ratio; and wherein the first control device includes a control unit for performing feedback control on the fuel air ratio regulating device to permit the fuel air ratio to approach a requested fuel air ratio.

17. The engine system according to claim 16, wherein the second controlled variable is a purging amount of fuel vapor produced in a fuel tank and purged into an air-intake passage of the engine; and wherein the second regulating device includes a vapor communication passage that connects the air-intake passage to the fuel tank, and a purge control valve provided along the vapor communication passage.

18. The engine system according to claim 15, further comprising a second control device that controls the second regulating device based on the signal received from the condition detecting device.

19. The engine system according to claim 18, wherein the second controlled variable is a purging amount of fuel vapor produced in a fuel tank and purged into an air-intake passage of the engine;

wherein the second regulating device includes a vapor communication passage that connects the air-intake passage to the fuel tank and a control valve provided along the vapor communication passage; and wherein the second control device includes a control unit for performing feedback control on the control valve.

20. The engine system according to claim 15, wherein the condition detecting device includes at least one component selected from a group that includes an engine speed sensor, a coolant temperature sensor, a pressure sensor, a throttle sensor, an idle switch and an air temperature sensor.

* * * * *